United States Patent [19]

Mesica

[11] Patent Number: 4,936,115

[45] Date of Patent: Jun. 26, 1990

[54] GEM SETTING

[76] Inventor: Zuri Mesica, 4093 Benedict Canyon Dr., Sherman Oaks, Calif. 91423

[21] Appl. No.: 194,961

[22] Filed: May 17, 1988

[51] Int. Cl.[5] ..... A44C 17/02

[52] U.S. Cl. ..... 63/26; 63/28

[58] Field of Search ..... 63/26, 27, 28, 15; 29/10, 160.6

[56] References Cited

U.S. PATENT DOCUMENTS

| | | | |
|---|---|---|---|
| D. 12,037 | 11/1880 | Vennin & Peltier . | |
| D. 14,225 | 8/1983 | Mackinney . | |
| D. 20,477 | 1/1891 | Mann . | |
| 22,797 | 9/1893 | Powers et al. | 63/28 X |
| D. 53,535 | 8/1919 | Schless . | |
| D. 54,547 | 3/1920 | Gilsey . | |
| D. 54,548 | 3/1920 | Gilsey . | |
| D. 55,952 | 2/1920 | Mayer . | |
| D. 107,649 | 12/1937 | Kiepe . | |
| D. 143,988 | 2/1946 | Pennino . | |
| D. 171,455 | 2/1954 | Manne . | |
| D. 190,514 | 6/1961 | Doering . | |
| D. 217,492 | 5/1970 | Gotze . | |
| D. 325,485 | 9/1885 | Blancard . | |
| 424,749 | 4/1890 | Zirnkilton . | |
| 630,197 | 8/1899 | Dover et al. | 63/28 |
| 802,326 | 10/1905 | Sadler . | |
| 1,319,251 | 10/1919 | Schless | 63/26 |
| 1,440,229 | 12/1922 | Mestekin | 63/28 |
| 1,476,462 | 12/1923 | Pejchar . | |
| 1,818,324 | 8/1931 | Hamin | 63/28 |
| 1,864,371 | 6/1932 | Prussian . | |
| 2,058,978 | 10/1936 | Hamin . | |
| 2,069,598 | 2/1937 | Arpels . | |
| 2,207,869 | 7/1940 | Monnier | 63/28 X |
| 2,749,597 | 6/1956 | Fus . | |

FOREIGN PATENT DOCUMENTS

| | | | |
|---|---|---|---|
| 1022974 | 3/1953 | France | 63/26 |
| 204926 | 10/1923 | United Kingdom | 63/28 |
| 821157 | 12/1955 | United Kingdom . | |

OTHER PUBLICATIONS

U.S. Design Patent Application Ser. No. 07/087,240 filed on 8/19/1987 entitled "Prestige Prongs with Internally Reflecting Hollow Diamond core of Tapered Baguettes" by Zuri Mesica.

U.S. Patent Application Ser. No. 07/306,350 filed on 2/3/1989 entitled "Gen Setting", by Zuri Mesica.

U.S. Design Patent Application Ser. No. 07/306,654 filed on 2/3/1989 entitled "Gem Setting", by Zuri Mesica.

*Primary Examiner*—Laurie K. Cranmer

*Attorney, Agent, or Firm*—Spensley Horn Jubas & Lubitz

[57] ABSTRACT

A gem setting elegantly mounts a gem in a diadem so the gem appears to be suspended above a base by a plurality of complementary gemstones. The setting permits light to pass inwardly through the complementary gemstones and into a pavilion of the gem to enhance the appearance of the gem.

9 Claims, 2 Drawing Sheets

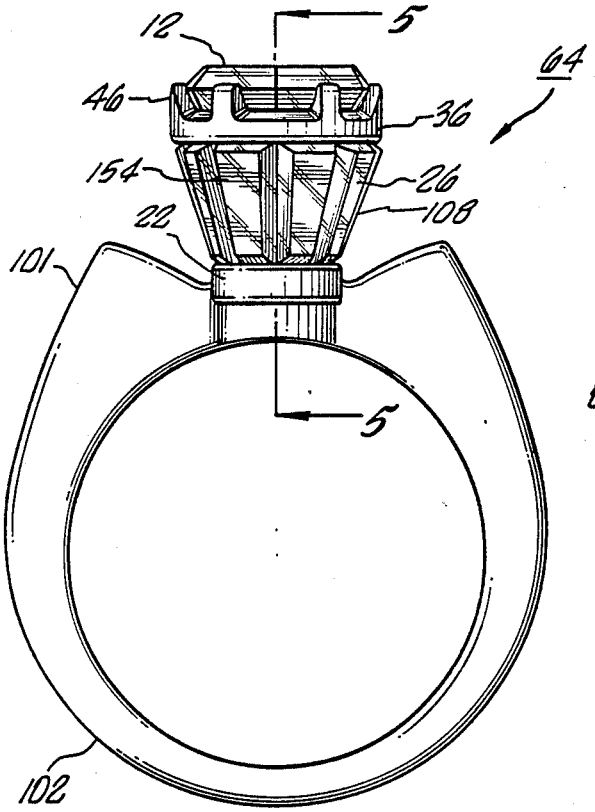
FIG. 4.
FIG. 5.
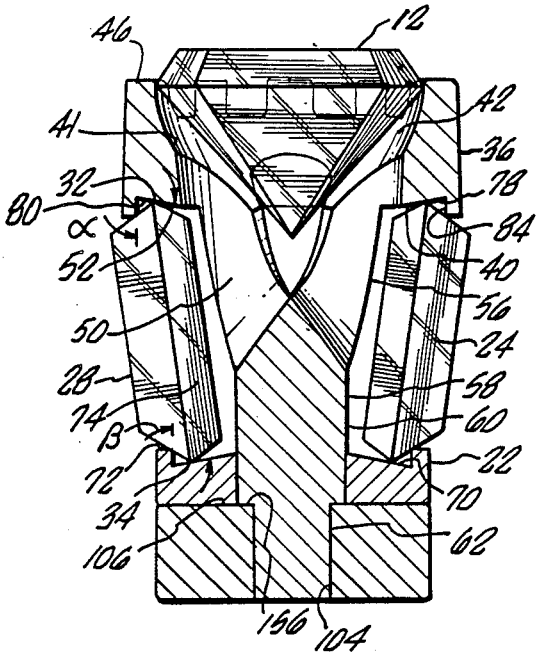
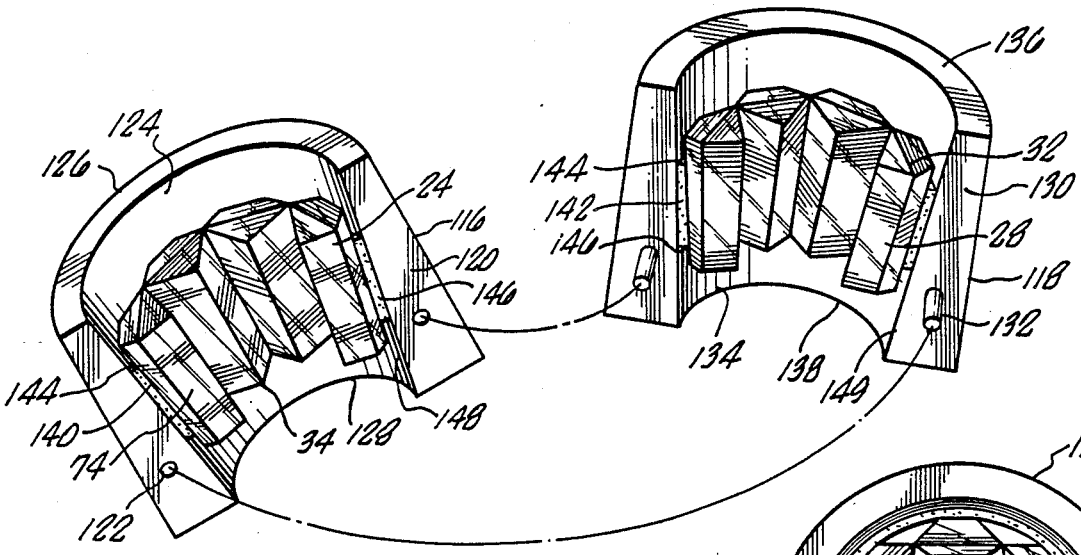
FIG. 6.
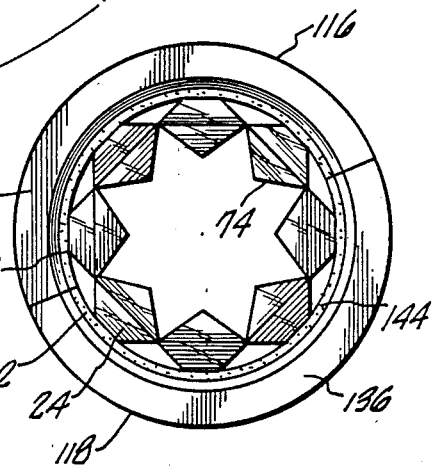
FIG. 7.

GEM SETTING

BACKGROUND

This invention relates to gem settings.

Diamonds are beautiful. Like paintings, the appearance of a gem can be significantly affected by the frame or setting into which it is mounted. Unfortunately, many gem settings merelY mount the gem, without enhancing the gem's appearance.

Therefore, it would be desirable to have an improved gem setting that not only mounts the gem, but also enhances the gem's appearance.

SUMMARY

According to this invention, an article of jewelry comprises (a) a gem, (b) complementary gemstones for enhancing the appearance of the gem, and (c) a setting for the gem and the complementary gemstones. The terms "gem" and "gemstone" as used herein refer to all types of precious and semi-precious stones, including natural stones, artificial stones, and glass. Gems and gemstones typically comprise a pavilion, a crown, and a girdle.

The setting comprises two main elements, a diadem and a base. The diadem comprises gem retaining means such as a collar having an upper surface, a lower surface, and a central cavity shaped to conform to and receive the gem, and a plurality of spaced apart prongs projecting upwardly from the upper surface for securely holding the gem within the cavity In the illustrated embodiment, the collar is annular and the cavity is conical.

The complementary gemstones are held between the diadem and the base bY retaining means The top edges of the complementary gemstones are retained by a recess in the lower surface of the collar and the bottom edges of the complementary gemstones are retained in a recess in the base. For example, the complementary gemstones can be sandwiched between the bottom of the collar and the top of the base. Preferably the base is axially movable with respect to the diadem before the setting is assembled so that the different length complementary gemstones can be retained between the diadem and the base.

The complementary gemstones can be mounted to enhance the appearance of the gem. To achieve this effect, preferably the gem extends through the collar so that inwardly facing faces of the complementary gemstones are exposed to and proximate at least a portion of the gem's pavilion. This allows at least a portion of light passing inwardly through the complementarY gemstones to enter the pavilion of the gem.

To maximize the amount of light refracted by the complementary gemstones into the gem pavilion, preferably the base and diadem are assembled so that the diadem and base are spaced apart a sufficient distance so that the gem is spaced apart from the base. Exemplary means for achieving this comprises an axially oriented alignment guide or shaft depending from the lower surface of the collar. A plurality of arms or appendages can connect the shaft to the lower surface of the collar. To facilitate aligning the diadem and the base, the base can have an opening in its upper surface designed to receive at least a portion of the shaft.

The shaft can have an extension for mounting the setting on display means to form a piece of jewelry. For example, the setting can be mounted by means of the extension in a circular band to form a ring.

The configuration of the complementary gemstones can be any shape desired. For example, with a circular base and an annular collar, the complementary gemstones can be contiguous to and form a solid circular perimeter around the portion of the pavilion that protrudes through the opening. This preferred configuration directs a large amount of light through the complementarY gemstones and into the main central gem for enhancing the appearance of the central gem.

Preferably the pavilion protrudes through the collar without Contacting the surface of the collar cavity or the arms to avoid obstructing the light that passes through the complementarY gemstones from entering the pavilion of the gem. For the same reason, preferably the complementary gemstones are not in contact with the arms or the shaft.

An exemplary first complementary gemstone retaining means is a first groove in the lower surface of the main body of the diadem that is formed by a first intersection of two surface. The first intersection has a first acute angle. An exemplary second complementary gemstone retaining means is a second groove in the top surface of the base. The second groove is formed by a second intersection of two surfaces and has a second acute angle.

The external contour of the mounted complementary gemstones can vary For example, when each complementary gemstone has substantially the same length and a tapered baguette shape, and when the first and second gemstone retaining means are circular and have a first diameter and a second diameter, respectively, the first diameter being larger than the second diameter, the mounted complementary gemstones have a beautiful, truncated, conical contour.

The gem setting of the present invention enhances the appearance of the gem. For example, the complementary gemstones are gracefully mounted between the diadem and the base to form a rich and elegant looking gem setting. In addition, the crown of contiguous complementary gemstones give the impression that the gem is luxuriously supported by a gem-like pillar. For certain gems, the passage of light inwardly through the complementary gemstones and into the pavilion of the gem can enhance the apparent brilliance and color of the gem.

DRAWINGS

These and other features, aspects, and advantages of the present invention will become better understood with reference to the following description, appended claims, and accompanying drawings where:

FIG. 4 is a side elevation view of an article of jewelry incorporating the setting of FIG. 1;

FIG. 5 is a fragmentary sectional view of the article of jewelry of FIG. 4 taken along line 5—5 of FIG. 4.

FIG. 6 is an exploded view of a die for use in manufacturing the of jewelry of FIG. 4; and FIG. 7 is a top plan view of the die of FIG. 6.

DESCRIPTION

Figure 1:
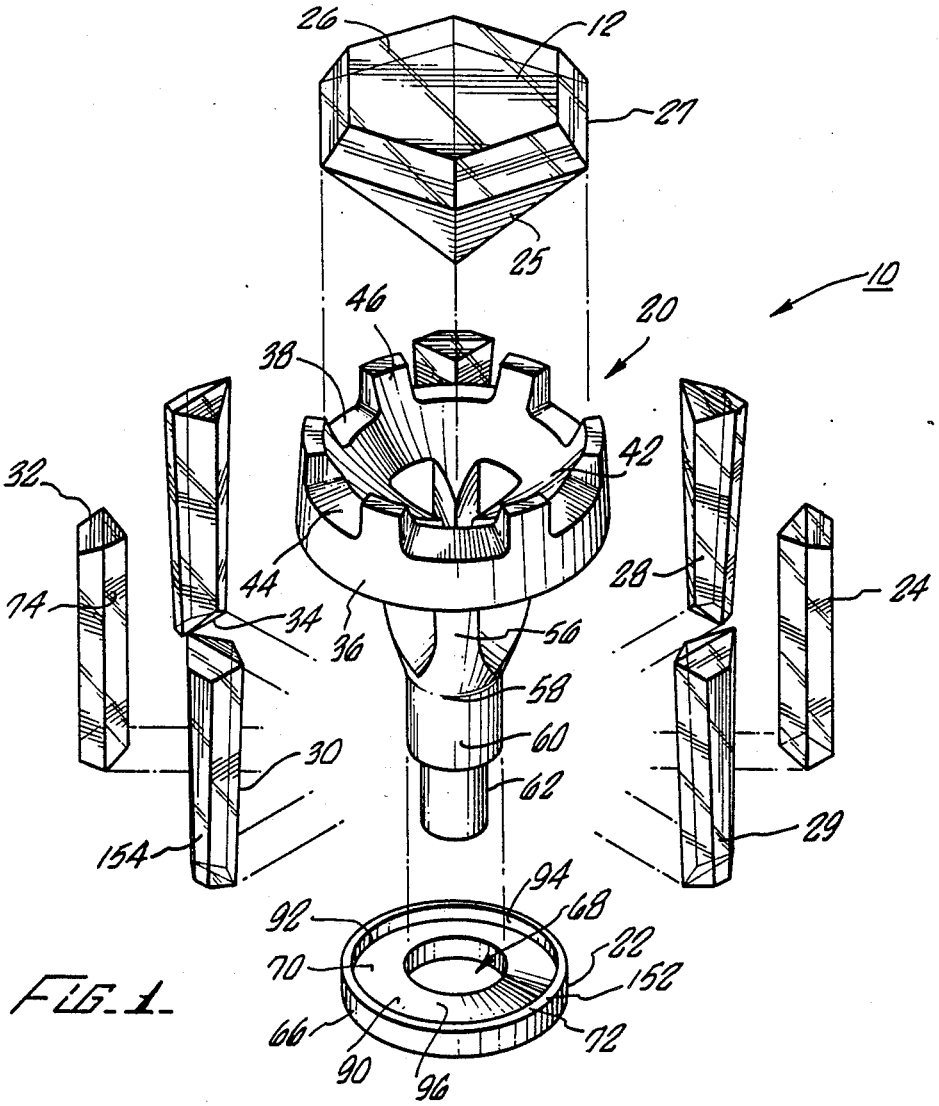
FIG. 1 is an exploded isometric view of a gem setting for mounting a gem embodying features of the present invention, the setting comprising a diadem and a base, and employing complementary gemstones.
Figure 2:
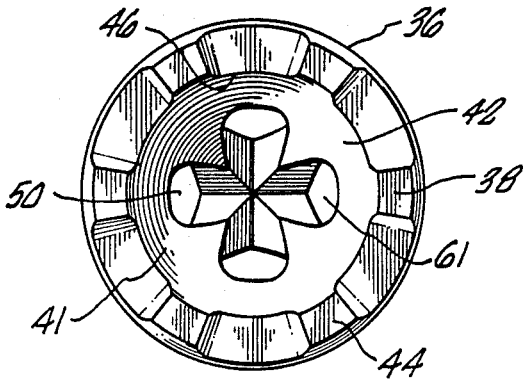
FIG. 2 is a top plan view of the diadem of FIG. 1.
Figure 3:
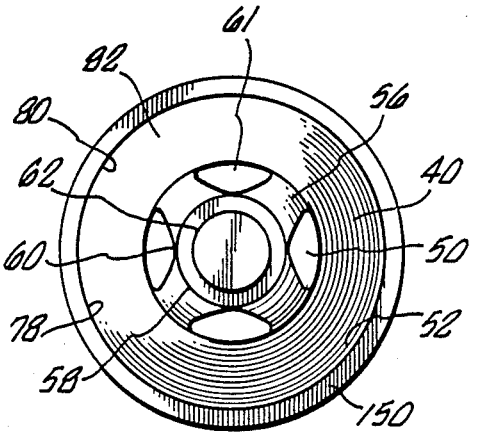
FIG. 3 is bottom plan view of the diadem of FIG. 1.

The present invention is directed to (a) a gem setting for enhancing the appearance of a gem, (b) an article of jewelry incorporating the setting, (c) a kit for use in making the gem setting, and (d) a method for assembling the gem setting. The setting of this invention enhances the appearance of the gem.

With reference to the Figures, the setting 10 comprises a gem 12, a diadem 20, a base 22, and a plurality of complementarY gemstones 24 securely retained between the diadem 20 and the base 22 to enhance the appearance of the gem 12. The gem 12 has a pavilion 25, a crown 26, and a girdle 27. Each complementary gemstone 24 has a pavilion 28, a crown 29, and a girdle 30, as well as an upper edge 32 and a lower edge 34.

The diadem 20 comprises an annular collar 36 having an upper surface 38 and a lower surface 40. The collar 36 has a central conical-shaped hole or cavity 42 therethrough. A plurality of prongs 46 for retaining the gem 12 project upwardly from the upper surface 38 of the collar 36. The gem 12 is retained bY the prongs 46 with its crown 26 exposed and with its pavilion 25 extending through the cavity 42 so that a portion of the pavilion 25 is exposed so that light enters it. The collar 36 has a first recess 52 in its lower surface 40 for retaining the upper edges 32 of the complementary gemstones 24.

The diadem 20 also comprises a plurality of arms or appendages 56 depending downwardly from the lower surface 40 of the collar 36. The downwardly depending arms 56 terminate in a shaft 58 having a main body 60 for receiving the base 22. The shaft 58 aligns the base 22 with the diadem 20. A gap 61 is formed between adjacent arms 56 to allow light to pass between the adjacent arms 56 into the pavilion 25 of the central gem 12. The shaft 58 has a jewelry mounting extension 62 for mounting the setting 10 on an article of jewelry 64. The jewelry mounting extension 62 has a smaller diameter than the diameter of the main body 60 of the shaft 58.

The base 22 has an annular-shaped body 66 having a central opening 68. A second recess 70 for retaining the lower edges 34 of the complementary gemstones 24 is located in a top surface 72 of the base 22. The second recess 70 surrounds the second central opening 68 of the base 22.

The setting 10 can be provided as a kit comprising the diadem 20 and the base 22 where the purchaser supplies the gem 12 and/or the gemstones 24. Before the base 22 is secured to the diadem 20, the base 22 is capable of being axially moved with respect to the shaft 58 to accommodate different length complementary gemstones 24. Thus different length complementarY gemstones 24 are capable of being mounted and retained between the first recess 52 in the diadem 20 and the second recess 70 in the base 22. However, for any given setting, preferablY all the complementary gemstones 24 have substantially the same length.

When the complementary gemstones 24 are mounted in the setting 10, inwardly facing faces 74 of the complementary gemstones 24 are proximate to and exposed to at least a portion of the pavilion 25 of the gem 12. Light passing inwardly through the mounted complementary gemstones 24 is refracted and at least a portion of the refracted light enters the pavilion 25 of the gem 12. For certain gems, e.g., diamonds, the passage of the refracted light into the pavilion 25 of the gem 12 can greatly enhance the appearance of the gem 12.

Preferably the prongs 46 hold the center gem 12 so that at least a portion of the pavilion 25 protrudes through diadem 20 to the space between the arms 56. By having the pavilion 25 protrude through the first transverse opening 50, the pavilion 25 is placed in close proximity to the inwardly facing faces 74 of the complementary gemstones 24. The close proximity of the inwardly facing faces 74 to the pavilion 25 is believed to further enhance the appearance of certain gems 12.

To avoid obstructing passage of light into the pavilion 25, it is preferred that the pavilion 25 not touch the surface 41 of the conical cavitY 42 or the arms 56. Similarly, to avoid obstructing light that passes through the complementary gemstones 24, it is preferred that the complementary gemstones 24 be mounted without substantially touching the arms 56 or the shaft 58 of the diadem 20. Furthermore, in order that most of the light entering the pavilion 25 of the gem 12 be refracted light, it is preferred that the complementary gemstones 24 be contiguously mounted.

An exemplary first recess 52 in the lower surface 40 of the collar 36 comprises a first groove 78 in the lower surface 40 of the collar 36 formed by a first intersection 80 of two surfaces 82 and 84 The first intersection 80 has a first acute angle =. Similarly, an exemplary second recess 70 in the top surface 72 of the base 22 comprises a second groove 90 in the top surface 72 of the base 22. The second groove 90 is formed by a second intersection 92 of two surfaces 94 and 96 The second intersection 92 has a second acute angle $\beta$.

Exemplary gems 12 and complementary gemstones 24 are diamonds, rubies, emeralds, sapphires, zircon, and glass. Typical shapes of the gem 12 are round, marque, square, pear, emerald cut and princess shapes. Typical shapes for the complementary gemstones 24 include baguette, tapered baguette, square, and round shapes. Exemplary center gem 12 sizes range from about half carat to larger. Exemplary complementary gemstones 24 have a length that ranges from about 3 mm and up. In order to securely retain the complementary gemstones 24 between the first and second recesses 52 and 70, respectivelY, it is preferred that the length of each complementary gemstone 24 be substantially the same to at least about a thousandth of an inch. In order to achieve this degree of exactness, it is preferred to use a device for measuring the lengths of the complementary gemstones 24 that is capable of accurately measuring the length of the complementary gemstones 24 to at least about one thousandth of an inch.

With respect to FIGS. 4 and 5, the gem setting 10 is incorporated into a ring 101 comprising a band 102 for displaying the setting 10. When incorporated into the ring 101, the jewelry mounting extension 62 of the shaft 58 matingly fits in an opening 104 in a mounting surface 106 of the band 102.

The overall appearance of the complementary gemstones 24 can be changed by varying the configuration of the first recess 52 in the lower surface 48 of the collar 36, the second recess 70 in the top surface 72 of the base 22, and the length and shape of the complementarY gemstones 24. For example, when the complementary gemstones 24 have substantially the same length, a tapered baguette shape, and are contiguouslY mounted between the first recess 52 having a first diameter and the second recess 70 having a second diameter, the first diameter being greater than the second diameter, the complementary gemstones 24 have a beautiful truncated, conical contour 108.

As shown in FIGS. 6 and 7, the setting can be assembled with the aid of a die 114 The die 114 has a mating female half 116 that mates with a male half 118. The female half 116 has first mating surfaces 120 having female alignment parts 122, a first inner surface 124, a first top end 126 and a first bottom end 128. The male half 118 of the die 114 has second mating surfaces 130, corresponding male alignment parts 132, a second inner surface 134, a second top end 136, and a second bottom end 138. A piece 140 of a two-sided adhesive tape is placed between the first top end 126 and first bottom end 128 of the female half 116. A second piece 142 of the two-sided adhesive tape is placed between the second top end 136 and the second bottom end 138 of the male half 118 of the die 114.

The complementary gemstones 24 are placed over each piece 140 and 142 of the two-sided adhesive in a manner so that the upper edge 32 and lower edge 34 of each complementary gemstone 24 extend beyond an upper edge 144 and a lower edge 146, respectively, of both pieces 140 and 142 of the two-sided adhesive. Typically, a sufficient number of complementary gemstones 24 are employed so that the complementary gemstones 24 positioned in each half 116 and 118 of the die 114 are contiguous and are substantially flush with each first intersection 148 between the first mating surfaces 120 and the first inner surface 124 and each second intersection 149 between the second mating surfaces 130 and the second inner surface 134. Generally, between four to seven, and typicallY five or six, complementary gemstones 24 are placed in each half 116 and 118 of the die 114. The female half 116 and male half 118 of the die 114 are then assembled together.

The diadem 20 is inserted into the assembled die 114 so that the upper edges 32 of the complementary gemstones 24 are capable of contacting the first recess 52 in the lower surface 40 of the collar 36. The base 22 is also inserted into the die 114 so that the lower edges 34 of the complementary gemstones 24 are capable of contacting the second recess 70 in the top surface 72 of the base 22. At least a portion of the shaft 58 is inserted into the second central opening 68 in the base 22. The thickness of the two-sided adhesive preferably is slightly wider than the width of a lower rim 150 of the diadem 20 and a top rim 152 of the base 22. This relationship provides sufficient room for the lower rim 150 of the diadem 20 and the upper rim 152 of the base 22 to readily slide between the inner surfaces 124 and 134 of the die 114 and each outer facing surface 154 of the complementary gemstones 24.

The diadem 20 and the base 22 are then subjected to axial pressure so that the base 22 slides along the shaft 58 until the upper edges 32 of the complementary gems 24 touch the first recess 52 and the lower edges 34 of the complementary gemstones 24 touch the second recess 70 to securely retain the complementary gemstones 24 in the setting 10. Once the base 22 is in its final position, jewelry solder 156 is used to immobilize the base 22 on the shaft 58.

The diadem 20, the base 22, and the ring 101 preferably are made from precious metals. Exemplary precious metals include gold and silver.

The gem setting 10 of the instant invention has a rich, majestic appearance. The crowns 28 of the complementary gemstones 24 are retained between the base 22 and the diadem 20 and enhance the appearance of the gem by imparting the impression that the gem 12 is supported by a luxurious gem-like pillar. In addition to being mounted in a very complementary environment, the passage of light inwardly through the complementary gemstones 24 and into the pavilion 25 of the gem 12 enhances the appearance and beauty of certain gems.

Although the present invention has been described in considerable detail with references to certain preferred version thereof, other versions are possible. For example, the diadem and base can be made from non-precious metals. In addition, other exemplary shapes of the base, the diadem, and their recesses for holding the complementary gemstones include rectangular, pentagonal, hexagonal, and octagonal shapes. Furthermore, earrings can also be used to display the setting of the instant invention. Therefore, the spirit and scope of the appended claims should not necessarily be limited to the descriptions of the preferred versions contained herein.

What is claimed is:

1. A setting comprising:

(a) a gem having a pavilion and a crown;

(b) a plurality of complementary gemstones each having an upper edge and a lower edge;

(c) a diadem comprising:

(i) gem retaining means securely retaining the gem with its crown exposed;

(ii) first complementary gemstone retaining means securely retaining the upper edges of the complementary gemstones; and (iii) an alignment guide depending downwardly from the diadem, the alignment guide comprising a shaft and a plurality of spaced apart arms depending downwardly from the diadem and supporting the shaft;

a base having an upper surface and comprising second complementary gemstone retaining means securely retaining the lower edges of the complementary gemstones and an opening receiving at least a portion of the alignment guide; and (e) means securing the base and the diadem together with the complementary gemstones sandwiched therebetween.

2. The setting of claim 1 wherein the diadem comprises a cavity through which the gem protrudes toward the base without touching the wall of the cavity or the arms.

3. The setting of claim 1 wherein the complementary gemstones are mounted without substantially touching the arms or the shaft of the diadem.

4. A setting comprising:

(a) a gem having a pavilion and a crown;

(b) a plurality of complementary gemstones each having an upper edge and a lower edge;

(c) a diadem comprising:

(i) a collar;

(ii) gem retaining means securely retaining the gem with its crown exposed; and (iii) a first complementary gemstone retaining means in the form of a firs recess in a lower surface of the collar for securely retaining the upper edges of the complementary gemstones;

(d) a base having an upper surface and comprising second complementary gemstone retaining means in the form of a second recess in a top surface of the base for securely retaining the lower edges of the complementary gemstones; and (e) means securing the base and the diadem together with and in optical communication with the pavilion of the gem the complementary gemstones sandwiched therebetween.

5. A setting comprising:
(a) a gem having a pavilion and a crown;
(b) a plurality of complementary gemstones each having an upper edge and a lower edge;
(c) a diadem comprising:
(i) gem retaining means securely retaining the gem with its crown exposed;
(ii) a collar having a lower surface; and
(iii) a first complementary gemstone retaining means in the form of a firs groove in a lower surface of the collar for securely retaining the upper edges of the complementary gemstone, the groove being formed by two surfaces intersecting at a first acute angle;
(d) a base having an upper surface and comprising second complementary gemstone retaining means in the form of a second groove in the top surface of the base formed by two other surfaces intersecting at a second acute angle for securely retaining the lower edges of the complementary gemstones; and
(e) means securing the base and the diadem together with and in optical communication with the pavilion of the gem the complementary gemstones sandwiched therebetween.

6. A setting comprising:
(a) a gem having a pavilion and a crown;
(b) a plurality of complementary gemstones each having an upper edge and a lower edge;
(c) a diadem comprising:
(i) gem retaining means securely retaining the gem with its crown exposed; and
(ii) first complementary gemstone retaining means securely retaining the upper edges of the complementary gemstones;
(d) a base having an upper surface and comprising second complementary gemstone retaining mans securely retaining the lower edges of the complementary gemstones; and
(e) means securing the base and the diadem together with the complementary gemstones sandwiched therebetween and in optical communication with the pavilion of the gem,
wherein each complementary gemstone has substantially the same length and a tapered baguetter shape, and the first and second gemstone retaining means are circular and having a first diameter and a second diameter, respectively, the first diameter being greater than the second diameter, and the complementary gemstones are contiguously mounted in a truncated, conical configuration.

7. A setting for a gem having a pavilion and a crown, comprising:
(a) a plurality of complementary gemstones each having an upper edge and a lower edge;
(b) a diadem comprising:
(i) a collar;
(ii) gem retaining means securely retaining the gem with its crown exposed and at least a portion of its pavilion exposed, the gem retaining means having an opening therethrough so that light can enter the pavilion of the gem; and
(iii) first complementary gemstone retaining means in the form of a first recess in a lower surface of the collar for securely retaining the upper edges of the complementary gemstones;
(c) a base having an upper surface and comprising second complementary gemstone retaining means in the form of a second recess in a top surface of the base for securely retaining the lower edges of the complementary gemstones with an inwardly facing faces of the complementary gemstones exposed to and proximate at least a part of the pavilion of the gem so that at least a portion of the light passing inwardly through the complementary gemstones enters the pavilion of the gem; and
(d) means securing the base and the diadem together with the complementary gemstones sandwiched therebetween.

8. A setting for a gem having a pavilion and a crown, comprising:
(a) a plurality of complementary gemstones each having an upper edge and a lower edge;
(b) a diadem comprising:
(i) gem retaining means securely retaining the gem with its crown exposed and at least a portion of its pavilion exposed, the gem retaining means having an opening therethrough so that light can enter the pavilion of the gem;
(ii) a collar having a lower surface; and
(iii) first complementary gemstone retaining means in the form of a first groove in a lower surface of the collar for securely retaining the upper edges of the complementary gemstones, the groove being formed by two surfaces intersecting at a first acute angle;
(c) a base having an upper surface and comprising second complementary gemstone retaining means in the form of a second groove in a top surface of the base formed by two other surfaces intersecting at a second acute angle for securely retaining the lower edges of the complementary gemstones with inwardly facing faces of the complementary gemstones exposed to and proximate at least a part of the pavilion of the gem so that at least a portion of the light passing inwardly through the complementary gemstones enters the pavilion of the gem; and
(d) means securing the base and the diadem together with the complementary gemstones sandwiched therebetween.

9. A setting for a gem having a pavilion and a crown, comprising:
(a) a plurality of complementary gemstones each having an upper edge and a lower edge;
(b) a diadem comprising:
(i) gem retaining means securely retaining the gem with its crown exposed and at least a portion of its pavilion exposed, the gem retaining means having an opening therethrough so that light can enter the pavilion of the gem; and
(ii) first complementary gemstone retaining means securely retaining the upper edges of the complementary gemstones;
(c) a base having an upper surface and comprising second complementary gemstone retaining means securely retaining the lower edges of the complementary gemstones with inwardly facing faces of the complementary gemstones exposed to and proximate at least a part of the pavilion of the gem so that at least a portion of the light passing inwardly through the complementary gemstones enters the pavilion of the gem; and
(d) means securing the base and the diadem together with the complementary gemstones sandwiched therebetween,
wherein each complementary gemstone has substantially the same length and a tapered baguetter shape, and the first and second gemstone retaining means are circular and having a first diameter and a second diameter, respectively, the first diameter being greater than the second diameter, and the complementary gemstones are contiguously mounted in a truncated, conical configuration.

* * * * *